US007401778B2

(12) United States Patent
Roberts

(10) Patent No.: US 7,401,778 B2
(45) Date of Patent: Jul. 22, 2008

(54) MULTI-SHEET FEED DETECTION SYSTEM

(75) Inventor: Troy Roberts, Loveland, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 280 days.

(21) Appl. No.: 11/259,188

(22) Filed: Oct. 25, 2005

(65) Prior Publication Data

US 2007/0090591 A1 Apr. 26, 2007

(51) Int. Cl.
*B65H 7/02* (2006.01)

(52) U.S. Cl. ..... 271/258.01; 271/262; 271/263; 399/215; 358/488; 358/496; 358/498; 250/559.11; 250/559.27

(58) Field of Classification Search ..... 271/258.01, 271/262, 263; 399/215; 358/488, 496, 498; 250/559.11, 559.27
See application file for complete search history.

(56) References Cited

U.S. PATENT DOCUMENTS 4,256,299 A 3/1981 Hogenson
5,105,078 A * 4/1992 Nochise et al. ..... 250/223 R
5,183,240 A 2/1993 Morooka et al.
5,531,434 A 7/1996 Kerschner
5,836,580 A * 11/1998 Hansen et al. ..... 271/9.13
6,040,923 A * 3/2000 Takashimizu et al. ..... 358/498
6,053,495 A 4/2000 Hara et al.
6,105,959 A * 8/2000 Miyata et al. ..... 271/263
6,417,937 B1 7/2002 Batten et al.
6,568,591 B2 * 5/2003 Modi ..... 235/379
6,672,587 B1 1/2004 Mohringer et al.
6,832,760 B2 12/2004 Jewell

* cited by examiner

*Primary Examiner*—David H Bollinger

(57) ABSTRACT

A multi-sheet feed detection system comprises a photosensor configured to receive light emitted in a non-visible spectrum by a transmitter through at least one sheet, and a detection module configured to detect a multi-sheet feed condition based on an amount of non-visible light received by the photosensor.

32 Claims, 2 Drawing Sheets

MULTI-SHEET FEED DETECTION SYSTEM

BACKGROUND OF THE INVENTION

Automatic document feeders (ADFs) are used to sequentially feed or move documents from a stack of documents to another location (e.g., to a platen or other type of imaging or non-imaging surface/location). However, ADFs can sometimes inadvertently feed multiple sheets simultaneously. Some ADFs, or devices associated with an ADF (e.g., copiers, scanners, etc.), are equipped with systems to detect simultaneously feeding of multiple sheets. However, such detection systems require expensive sensors, amplifiers, digital logic circuitry and other components that increase the cost and complexity of the ADF and/or ADF-associated device.

BRIEF DESCRIPTION OF THE DRAWINGS

For a more complete understanding of the present invention, and the objects and advantages thereof, reference is now made to the following descriptions taken in connection with the accompanying drawings in which.

DETAILED DESCRIPTION OF THE DRAWINGS

Figure 1:
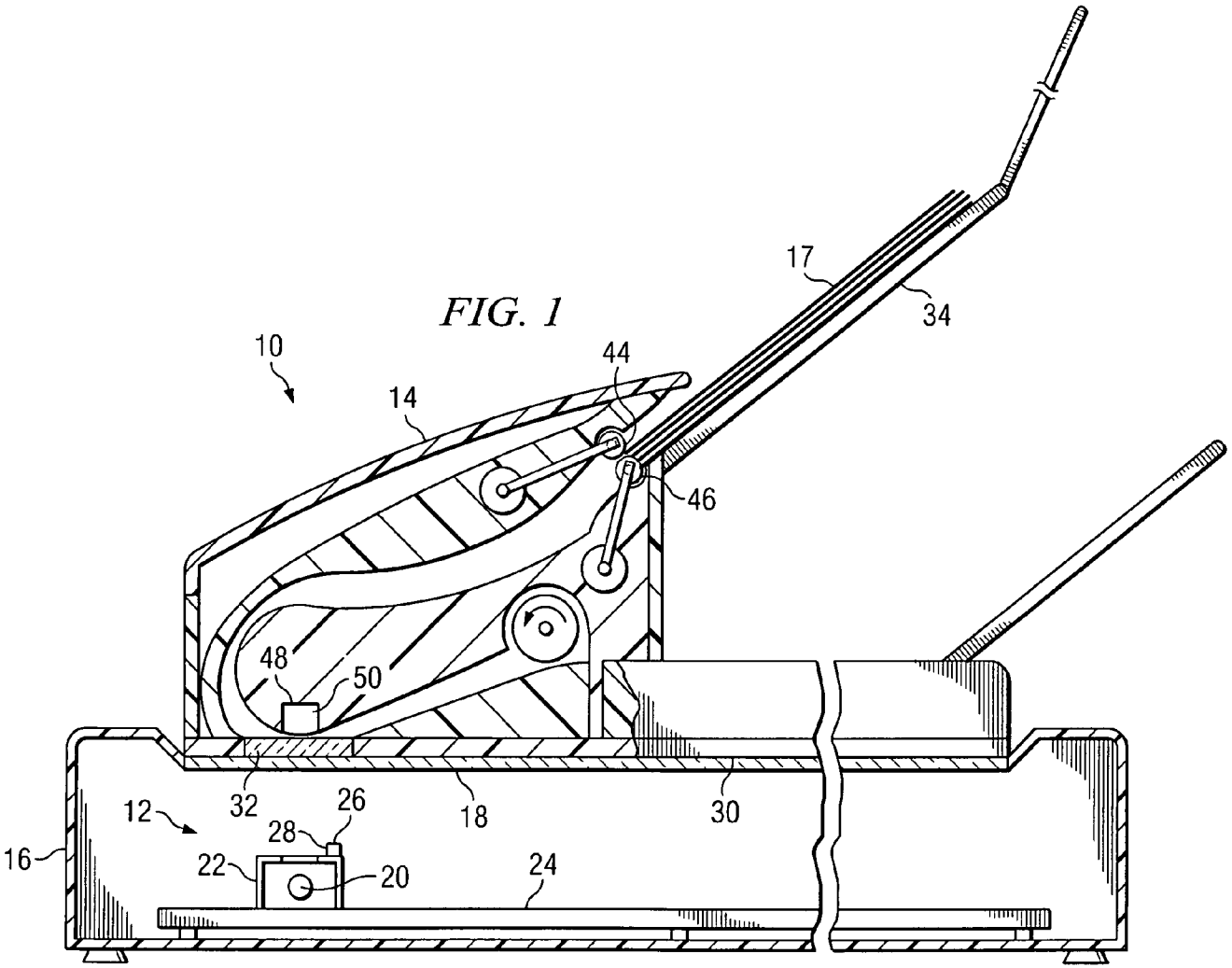
FIG. 1 is a diagram illustrating a section view of an imaging device in which an embodiment of a multi-page feed detection system is employed to advantage in accordance with the present invention.
Figure 2:
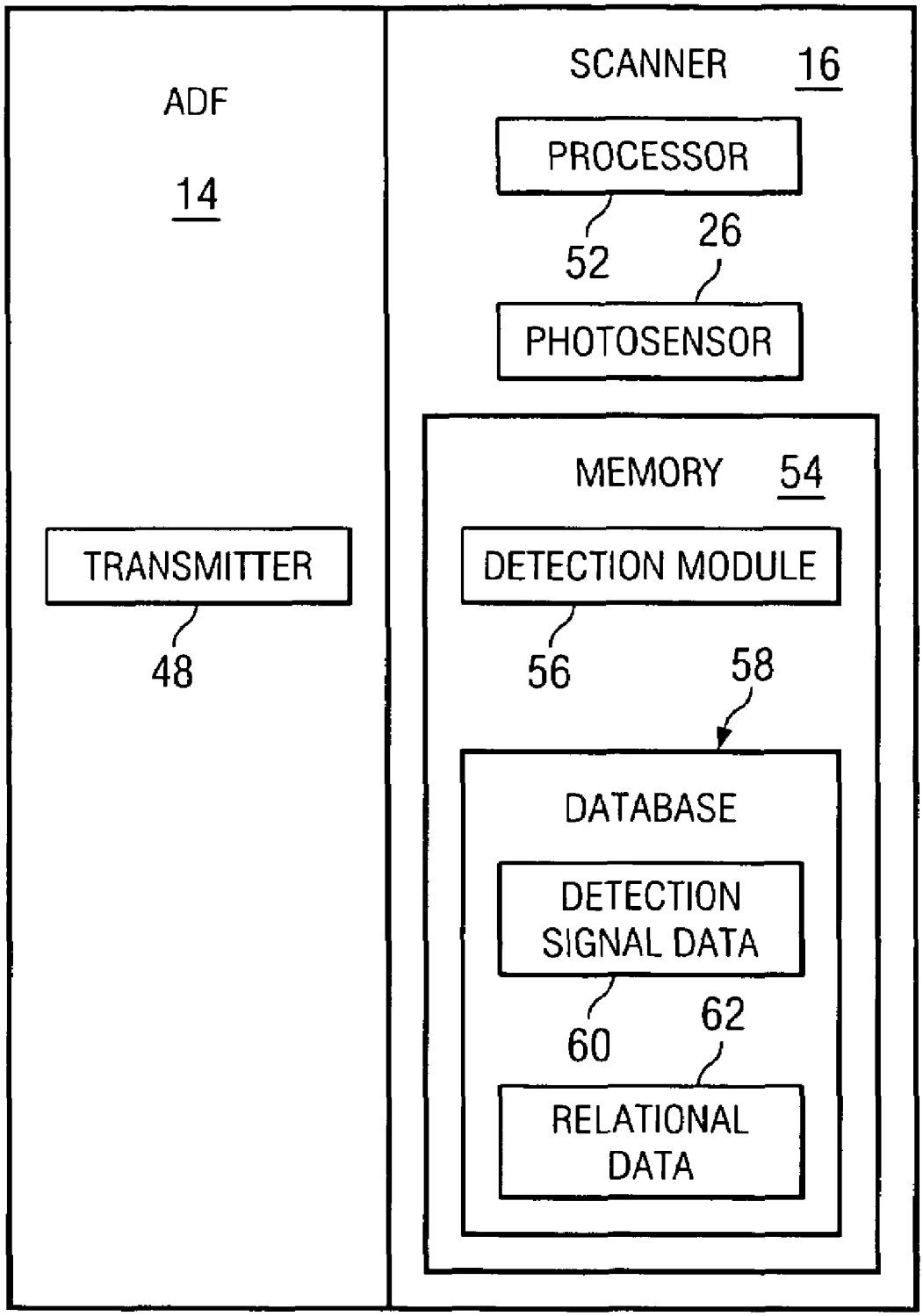
FIG. 2 is a block diagram illustrating an embodiment of the image capture device of FIG. 1.

The preferred embodiments of the present invention and the advantages thereof are best understood by referring to FIGS. 1 and 2 of the drawings, like numerals being used for like and corresponding parts of the various drawings.

FIG. 1 is a diagram illustrating a section view of an image capture device 10 in which an embodiment of a multi-sheet feed detection system 12 is employed to advantage in accordance with the present invention. In the embodiment illustrated in FIG. 1, image capture device 10 comprises an automatic document feeder (ADF) 14 coupled to a scanner 16. ADF 14 is configured to sequentially feed sheet(s) 17 to scanner 16 for imaging thereof by scanner 16. It should be understood that image capture device 10 can comprise other types of systems, including, but not limited to, facsimile machines, photocopiers and printers. Further a "sheet" may comprise any type of object capable of being fed by ADF 14 such as, but not limited to, a paper document or photograph.

In the embodiment illustrated in FIG. 1, scanner 16 comprises a platen 18, a lamp 20, a photosensor 26, and a carriage 22. Carriage 22 is preferably configured to move lamp 20 and photosensor 26 along a rail 24 relative to a sheet 17 to facilitate scanning of a stationary sheet 17. However, it should be understood that carriage 22 may also remain stationary during a scanning operation while sheet 17 is moved past or relative to photosensor 26. In the embodiment illustrated in FIG. 1, photosensor 26 comprises an array of charge coupled devices (CCDs) 28; however, it should be understood that photosensor 26 may comprise another type of device for converting light to electrical signals.

In the embodiment illustrated in FIG. 1, ADF 14 comprises a surface 30 configured to be disposed against and/or toward platen 18 having a scan window 32 to enable sheet 17 to be exposed to photosensor 26 during feeding of sheet 17 past scanner 16. ADF 14 further comprises an input tray 34 for holding and/or otherwise supporting a stack of sheets 17. In the embodiment illustrated in FIG. 1, ADF 14 is preferably configured to sequentially feed a single sheet 17 at a time past scanner 16 for imaging thereof (e.g., a single sheet 17 is picked up by feed rollers 44 and 46 and driven across scan window 32). Thus, in operation, carriage 22 is positioned below scan window 32 such that light radiated from lamp 20 will pass through platen 18 and scan window 32 and reflect from a portion of sheet 17 adjacent scan window 32. The reflected light returns through scan window 32 and platen 18 and is thereafter collected by photosensor 26 where the light is converted into one or more electric signals representative of a scanned image of the sheet 17. It should also be understood that scanner 16 and/or ADF 14 may be configured for transmissive scanning operations.

In the embodiment illustrated in FIG. 1, multi-sheet feed detection system 12 is configured to detect inadvertent feeding of multiple sheets 17 using the same photosensor 26 that is used to generate a scanned image of sheet 17. In the embodiment illustrated in FIG. 1, multi-sheet feed detection system 12 comprises a transmitter 48, such as a light emitting diode (LED) 50 or other type of light source, for emitting light through scan window 32 toward photosensor 26 such that light collected and/or otherwise received by photosensor 26 from transmitter 48 is used to detect whether multiple sheets 17 have been inadvertently fed past scan window 32. Preferably, light from at least one portion of a light spectrum different than a portion of the light spectrum used to generate a scanned image of the sheet 17 is used to detect whether multiple sheets 17 have been inadvertently fed past scan window 32. For example, in one embodiment of the present invention, transmitter 48 is configured to emit light corresponding to a non-visible spectrum, such as infrared (IR) light, that is received and/or collected by photosensor 26 and used to detect whether multiple sheets 17 have been inadvertently fed past scan window 32. However, it should be understood that different portions of the visible light spectrum may also be used (e.g., one portion and/or frequency(ies) of the visible light spectrum used for multi-sheet feed detection and another, different portion and/or frequency(ies) of the visible light spectrum used for scanned image generation).

In the embodiment illustrated in FIG. 1, transmitter 48 is disposed within ADF 14 in a position generally aligned with a position of photosensor 26. However, it should be understood that transmitter 48 may be otherwise located (e.g., transmitter 48 disposed within scanner 16 and another photosensor disposed within ADF 14). In the embodiment illustrated in FIG. 1, transmitter 48 is positioned to transmit light through at least a portion of sheet(s) 17 being fed past scan window 32 (e.g., preferably an edge or other portion of sheet (s) where there is less likelihood of print, graphics and/or any other type of media on sheet(s) 17 that may otherwise obstruct light emitted by transmitter 48 from passing through sheet(s) 17). In operation, the light emitted by transmitter 48 and passing through sheet(s) 17 is collected by photosensor 26 and used to determine whether a single sheet 17 has been fed by ADF 14 or whether multiple sheets 17 have been fed by ADF 14. In FIG. 1, a single transmitter 48 is illustrated; however, it should be understood that a greater number of transmitters 48 may be used (e.g., disposed at various locations across a scan line of scan window 32). As described above, preferably, the same photosensor 26 that is used to generate a scanned image of sheet 17 is used to collect IR light for detecting a quantity of fed sheets 17, thereby reducing costs associated with manufacturing system 12. However, it should be understood that a separate and/or additional photosensor may be used in combination with transmitter 48 if desired.

FIG. 2 is a block diagram illustrating an embodiment of image capture device 10 of FIG. 1. In the embodiment illustrated in FIG. 2, scanner 16 comprises a processor 52 coupled to photosensor 26 and a memory 54. In the embodiment illustrated in FIG. 2, memory 54 comprises a detection module 56 and a database 58. Detection module 56 may comprise hardware, software, or a combination of hardware and software. In FIG. 2, detection module 56 is illustrated as being stored in memory 54 so as to be accessible and/or executable by processor 52. However, it should be understood that detection module 56 may be otherwise stored, even remotely. Detection module 56 is used to analyze optical signals collected by photosensor 26 emitted by transmitter 48 to determine whether a single sheet 17 has been fed by ADF 14 or whether multiple sheets 17 have been fed by ADF 14.

In the embodiment illustrated in FIG. 2, database 58 comprises detection signal data 60 and relational data 62. Detection signal data 60 comprises information associated with optical signals collected by photosensor 26 emitted by transmitter 48. Relational data 62 comprises information associated with known and/or predetermined optical signal values that are used to evaluate the detected signal data 60 to determine whether a single sheet 17 has been fed by ADF 14 or whether multiple sheets 17 have been fed by ADF 14. For example, in some embodiments of the present invention, relational data 62 comprises known and/or predetermined value ranges (e.g., a predetermined value and associated tolerance) corresponding to an amount and/or amplitude of IR light generally received by photosensor 26 transmitted through a single sheet 17.

In operation, relational data 62 is compared against detection signal data 60 by detection module 56 to determine whether a single sheet 17 has been fed by ADF 14 or whether multiple sheets 17 have been fed by ADF 14. If detection signal data 56 falls outside the predetermined value range indicated by relational data 62 for a single sheet 17, detection module 56 transmits and/or otherwise generates a software interrupt or other signal to alert a user of a misfeed condition. For example, in some embodiments of the present invention, detection module 56 is configured to control actuation of transmitter 48 during a scanning operation (e.g., either intermittent or continuous activation of transmitter 48). Light emitted by transmitter 48 is directed toward photosensor 26 and passes through sheet(s) 17 being fed by ADF 14 past scan window 32. Photosensor 26 receives the IR light transmitted through sheet(s) 17 from transmitter 48 and information associated with the received IR light is stored in memory 54 as detection signal data 60 (although it should be understood that at some point, particular quantity of sheets 17 may prevent any IR signals from reaching photosensor 26). Detection module 56 compares the detection signal data 60 with relational data 62 to determine a quantity of sheet(s) 17 fed by ADF 14. For example, in response to multiple sheets 17 being simultaneously fed past scan window 32, a reduced level of IR light will reach photosensor 26. Accordingly, the reduced level of IR light received by photosensor 26 is indicated by detection signal data 60 and used by detection module 56 to detect a multi-sheet 17 feed (e.g., the detection signal data 60 falling outside a predetermined or known value range as indicated by relational data 62). In response to detecting a multi-sheet 17 feed, detection module 56 transmits an alert and/or otherwise notifies a user of the mis-feed condition.

Relational data 62 preferably comprises relational information associated with a variety of different types of sheets 17 (e.g., different types and/or thicknesses of paper or media) such that detection module 56 determines the quantity of sheets 17 fed based on the type of sheet 17. For example, in some embodiments of the present invention, detection module 56 is configured to receive user input (e.g., via a user interface or other input device) indicating a particular type of sheet 17 being fed and/or scanned. In response to receiving an indication of the particular type of sheet 17 being fed and/or scanned, detection module 56 uses the corresponding type of relational data 62 to analyze detection signal data 60.

Thus, embodiments of the present invention enable multi-sheet feed detection system 12 to detect multi-sheet 17 feeds using the same photosensor 26 that is used to capture image data corresponding to the sheet 17. For example, embodiments of the present invention use non-visible light emitted from transmitter 48 captured by the same photosensor 26 that is used to capture image data associated with the sheet 17 to detect whether multiple sheets 17 have been inadvertently fed.

What is claimed is:

1. A multi-sheet feed detection system, comprising:

a photosensor configured to receive light emitted in a non-visible spectrum by a transmitter through at least one sheet and configured to receive visible light for generating a scanned image of a sheet; and a detection module configured to detect a multi-sheet feed condition based on an amount of non-visible light received by the photosensor.

2. The system of claim 1, wherein the transmitter comprises an infrared (IR) light emitting diode (LED).

3. The system of claim 1, wherein the transmitter is disposed in an automatic document feeder (ADF).

4. The system of claim 1, wherein the photosensor is disposed in a scanner.

5. The system of claim 1, wherein the detection module is configured to compare the amount of non-visible light received by the photosensor to relational data to detect the multi-sheet feed condition.

6. The system of claim 1, wherein the detection module is configured to control activation of the transmitter.

7. The system of claim 1, wherein the detection module is configured to generate an indication of the multi-sheet feed condition.

8. The system of claim 1, wherein the detection module is configured to receive an indication from a user of a type of the at least one sheet.

9. The system of claim 1, wherein the detection module is configured to detect the multi-sheet feed condition based on a type of the at least one sheet.

10. A multi-sheet feed detection system, comprising:

means for receiving light emitted in a non-visible spectrum through at least one sheet, the receiving means comprises means for receiving light in a visible spectrum for generating a scanned image of a sheet; and means for detecting a multi-sheet feed condition based on an amount of non-visible light received by the receiving means.

11. The system of claim 10, further comprising means for transmitting the light in the non-visible spectrum toward the receiving means.

12. The system of claim 11, wherein the detecting means comprises means for controlling activation of the transmitting means.

13. The system of claim 10, further comprising a transmitting means disposed in an automatic feed means for transmitting the non-visible light toward the receiving means.

14. A method of manufacturing a multi-sheet feed detection system, comprising:

providing a photosensor configured to receive light emitted by a transmitter in a non-visible spectrum through at least one sheet;

providing a detection module configured to detect a multi-sheet feed condition based on an amount of non-visible light received by the photosensor; and configuring the photosensor to receive light in a visible spectrum for generating a scanned image of a sheet.

15. The method of claim 14, further comprising.

16. The method of claim 14, further comprising configuring the transmitter as a light emitting diode (LED).

17. The method of claim 14, further comprising disposing the transmitter in an automatic document feeder (ADF).

18. The method of claim 14, further comprising disposing the photosensor in a scanner.

19. The method of claim 14, further comprising configuring the detection module to control activation of the transmitter.

20. The method of claim 14, further comprising configuring the detection module to compare the amount of non-visible light received by the photosensor to relational data to detect the multi-sheet feed condition.

21. The method of claim 14, further comprising configuring the transmitter to emit infrared light.

22. The method of claim 14, further comprising configuring the detection module to receive an indication of a type of the at least one sheet.

23. The method of claim 14, further comprising configuring the detection module to detect the multi-sheet feed condition based on a type of the at least one sheet.

24. A multi-sheet feed detection system, comprising:

a photosensor configured to receive light in a first portion of a light spectrum for generating a scanned image of at least one sheet; and a detection module configured to detect a multi-sheet feed condition based on an amount of light transmitted through at least a portion of the at least one sheet and collected by the photosensor in a different portion of the light spectrum than the first portion.

25. The system of claim 24, wherein the different portion of the light spectrum comprises infrared light.

26. The system of claim 24, wherein the photosensor is disposed in a scanner.

27. The system of claim 24, wherein the detection module is configured to compare the amount of the light received by the photosensor in the different portion of the light spectrum to relational data to detect the multi-sheet feed condition.

28. The system of claim 24, wherein the light in the different portion of the light spectrum is emitted toward the photosensor through a scan window of an automatic document feeder (ADF).

29. The system of claim 24, wherein the detection module is configured to generate an indication of a multi-sheet feed condition.

30. The system of claim 24, wherein the detection module is configured to indicate a multi-sheet feed condition if an amount of the light received by the photosensor in the different portion of the light spectrum falls outside a predetermined value range.

31. The system of claim 24, wherein the detection module is configured to receive an indication of a type of the at least one sheet.

32. The system of claim 24, wherein the detection module is configured to detect the multi-sheet feed condition based on a type of the at least one sheet.

* * * * *

UNITED STATES PATENT AND TRADEMARK OFFICE

CERTIFICATE OF CORRECTION

PATENT NO. : 7,401,778 B2
APPLICATION NO. : 11/259188
DATED : July 22, 2008
INVENTOR(S) : Troy Roberts It is certified that error appears in the above-identified patent and that said Letters Patent is hereby corrected as shown below:

In column 5, line 9, in Claim 15, after “comprising” insert -- configuring the photosensor to receive light in a visible spectrum for generating a scanned image of a sheet --.

Signed and Sealed this

Twelfth Day of May, 2009

JOHN DOLL
*Acting Director of the United States Patent and Trademark Office*